US005386809A

United States Patent [19]

Reedy et al.

[11] Patent Number: 5,386,809

[45] Date of Patent: Feb. 7, 1995

[54] PRESSURE RELIEF VALVE FOR COMPRESSION ENGINE BRAKING SYSTEM

[75] Inventors: Steven W. Reedy; David A. Vittorio, both of Columbus, Ind.

[73] Assignee: Cummins Engine Company, Inc., Columbus, Ind.

[21] Appl. No.: 141,064

[22] Filed: Oct. 26, 1993

[51] Int. Cl.[6] ..... F02D 31/00

[52] U.S. Cl. ..... 123/320; 123/90.12

[58] Field of Search ..... 123/320, 321, 90.15, 123/198 F, 90.12, 90.43, 90.45, 90.46

[56] References Cited

U.S. PATENT DOCUMENTS

| | | | |
|---|---|---|---|
| 3,220,392 | 11/1965 | Cummins | 123/321 |
| 3,405,699 | 10/1968 | Laas | 123/320 |
| 4,150,640 | 4/1979 | Egan | 123/90.15 |
| 4,271,796 | 6/1981 | Sickler et al. | 123/321 |
| 4,384,558 | 5/1983 | Johnson | 123/321 |
| 4,423,712 | 1/1984 | Mayne et al. | 123/321 |
| 4,572,114 | 2/1986 | Sickler | 123/321 |
| 4,592,319 | 6/1986 | Meistrick | 123/321 |
| 4,706,624 | 11/1987 | Meistrick et al. | 123/321 |
| 4,936,273 | 6/1990 | Myers | 123/321 |
| 4,996,957 | 3/1991 | Meistrick | 123/321 |
| 5,036,810 | 8/1991 | Meneely | 123/321 |

FOREIGN PATENT DOCUMENTS

| | | | |
|---|---|---|---|
| 2-223617 | 9/1990 | Japan | 123/320 |
| 912138 | 12/1962 | United Kingdom | 123/320 |

*Primary Examiner*—David A. Okonsky
*Attorney, Agent, or Firm*—Sixbey, Friedman, Leedom & Ferguson

[57] ABSTRACT

A compression braking system for an internal combustion engine having at least one working piston including a master piston operated by an engine component such as a fuel injector actuating mechanism and a slave piston fluidically connected with the master piston to open an engine exhaust valve wherein a pressure relief valve is provided to prevent excessively high pressure supply fluid from a low pressure supply circuit from reaching the high pressure circuit connecting the master and slave pistons thereby preventing inadvertent and excessive movement of the slave piston and possible damage to the engine. The pressure relief valve is fluidically connected to the low pressure supply circuit upstream of a control valve which separates the low and high fluid circuits and opens to vent fluid from the low pressure circuit while allowing continuous, uninterrupted operation of the engine in the braking mode. The pressure relief valve may include a spring biased check valve normally biased in a closed position and movable into the open position whenever the pressure in the low pressure circuit reaches a predetermined level to maintain the fluid in the low pressure circuit below a predetermined pressure level equivalent to a maximum high pressure level in the high pressure circuit capable of moving the slave piston.

14 Claims, 4 Drawing Sheets

PRESSURE RELIEF VALVE FOR COMPRESSION ENGINE BRAKING SYSTEM

TECHNICAL FIELD

This invention relates to valve control systems for selectively operating an internal combustion engine in either a power mode or a braking mode.

BACKGROUND OF THE INVENTION

While the advantages of obtaining a braking effect from the engine of a vehicle powered by an internal combustion engine are well known (see for example U.S. Pat. No. 3,220,392 to Cummins), an ideal braking system design characterized by low cost, simplicity, ease of maintenance and reliability has not yet been fully achieved. One well-known approach has been to convert the engine into a compressor by cutting off fuel flow and, opening the exhaust valve for each cylinder near the end of the compression stroke; thus, permitting the conversion of the kinetic inertial energy of the vehicle into compressed gas energy which may be released to atmosphere when the exhaust valves are partially opened. To operate the engine reliably as a compressor, rather exacting control is necessary over the timed relationship of exhaust valve opening and closing relative to the movement of the associated piston.

One technique for accomplishing this result is disclosed in U.S. Pat. No. 3,220,392 to Cummins, wherein a slave hydraulic piston opens an exhaust valve near the end of the compression stroke of an engine piston with which the exhaust valve is associated. The slave piston which opens the exhaust valve is actuated by a master piston hydraulically linked to the slave piston and mechanically actuated by an engine element which is displaced periodically in timed relationship with the compression stroke of the engine. One such engine element may be the exhaust valve train of another cylinder timed to open shortly before the first engine cylinder piston reaches the top dead center of its compression stroke. Other engine operating elements or components may be used to actuate the master piston of the braking system so long as the actuation of the master piston occurs at the proper moment near the end of the compression stroke of the piston whose associated exhaust valve is to be actuated by the slave piston. For example, certain types of compression ignition engines are equipped with fuel injector actuating mechanisms which are mechanically actuated near the end of the compression stroke of the engine piston with which the fuel injector train is associated, thus, providing an actuating mechanism immediately adjacent the valve which is to be opened. See also U.S. Pat. No. 3,405,699 to Laas.

The use of a hydraulically-linked master/slave piston assembly in a system for selectively converting an internal combustion engine from a power mode to a compressor or brake mode of operation has proven to be commercially viable and relatively simple especially in engines already equipped with appropriately timed fuel injector actuating mechanisms. However, certain difficulties have arisen during the operation of these braking systems. For example, the system disclosed in U.S. Pat. No. 3,220,392 uses a control valve which separates the braking system into a high pressure circuit and a low pressure circuit by using a check valve which prevents flow of high pressure fluid back into the low pressure supply circuit thereby allowing the formation of the hydraulic link in the high pressure circuit when in the braking mode. A three-way solenoid valve, positioned upstream of the control valve, controls the flow of low pressure fluid to the control valve and, thus, controls the beginning and end of the braking mode. When the engine is in a power mode distinct from the braking mode, the solenoid valve connects the low pressure circuit to drain which causes the control valve to fluidically connect the high pressure circuit to drain, thus, terminating-the hydraulic link. However, it has been found that under certain operating conditions, supply fluid having an undesirably high fluid pressure is supplied to the control valve via the solenoid valve during the braking mode. Such a high supply pressure has been found to cause the inadvertent movement of the slave piston and, thus, movement of the exhaust valves, inwardly beyond the design clearance limits between the valve face and the engine piston possibly causing damage to the valves, valve train assembly, piston/cylinder assembly and other engine components by, for example, contact between the engine piston and the exhaust valves. The uncontrollable high pressure surges in the low pressure supply circuit are often caused by an overly viscous supply of fluid. Fluid having an undesirably high viscosity may result from the thermal effects of low ambient temperature conditions on the fluid when the engine is not is use. Higher viscosity fluid causes an increase in the supply pressure from the supply pump into the low pressure circuit. Also, higher than expected supply pressures may result from a malfunction in the fluid supply pump feeding fluid to the low pressure circuit. Regardless of the cause, undesirably high fluid supply pressure in the low pressure circuit may cause serious damage to the engine when in the braking mode.

As a result, at least one attempt has been made to prevent such an occurrence. For example, as shown in FIGS. 5A–5C, the assignees of the present invention have designed a control valve having an integral pressure relief valve function to sense the fluid pressure in the low pressure circuit above a predetermined level and to respond by venting fluid from the high pressure circuit to prevent the pressure in the high pressure circuit from reaching a predetermined maximum pressure corresponding to the force needed to inadvertently move the exhaust valves into the cylinder of the engine. The control valve includes a slidably mounted control valve member including a spring biased check valve which prevents the flow from the high pressure circuit back into the low pressure circuit. The control valve member is spring biased into a first position by an inner spring thereby blocking flow through the control valve member and connecting the high pressure circuit to drain. When the solenoid valve is moved to an open position supplying fluid to the low pressure circuit to place the engine in a brake mode, the fluid pressure moves the control valve member compressing the inner spring until the control valve member contacts an outer spring thereby allowing fluidic communication between the high pressure and low pressure circuits via passages formed in the control valve member. In the event of an undesirably high supply pressure in the low pressure circuit, the control valve member moves further outwardly compressing the outer spring and connecting the high pressure circuit with a low pressure drain to reduce the pressure in the high pressure circuit to a predetermined level to prevent inadvertent and excessive movement of the slave piston. However, the braking system cannot function in the braking mode while the control valve is in the relief position venting fluid from the high pressure circuit since the control valve opens the high pressure circuit to drain, thus, disabling the hydraulic link which transmits the force from the master piston to the slave piston for moving the exhaust valves. As a result, the pressure relief function of the control valve of this design disadvantageously affects the reliability and the effectiveness of the braking system. Moreover, it has been found that this integral pressure relief valve/control valve design requires the inner spring of the control valve to experience excessive linear motion ultimately causing control valve spring failure. Design of a more appropriate and durable spring has been limited by the allowable package size of the control valve housing which does not permit for a spring design capable of withstanding the necessary displacements of the present control valve.

U.S. Pat. Nos. 4,150,640, 4,271,796 and 5,036,810 all disclose engine compression brake systems having a form of pressure relief means for relieving fluid pressure in the high pressure fluid circuit connecting the master and slave pistons. However, these systems do not allow continuous, uninterrupted operation of the system in the braking mode while the pressure relief means is functioning and, therefore, are not as reliable and effective as desired.

SUMMARY OF THE INVENTION

It is an object of the invention, therefore, to overcome the disadvantages of the prior art and to provide a compression engine braking system capable of reliably and effectively operating the engine in a energy absorbing mode by converting the engine to an air compressor.

It is another object of the present invention to provide a compression engine braking system which prevents excessively high supply fluid pressure from being delivered to the high pressure circuit of the braking system thereby preventing undesirable operation of the braking system and/or damage to the engine.

It is yet another object of the present invention to provide a compression engine braking system using a pressure relief valve in the low pressure supply circuit to maintain the fluid supply pressure below a maximum predetermined level while permitting the continuous operation of the engine in a braking mode.

It is a further object of the present invention to provide a compression engine braking system which prevents damage to the exhaust valves, the engine's piston/cylinder assembly and other engine components by preventing the movement of the exhaust valves beyond their design clearance limits within the cylinder.

It is a still further object of the present invention to provide a compression engine braking system having a control valve member which requires only one bias spring for the control valve member while effectively maintaining the supply fluid pressure below a maximum predetermined level.

Still another object of the present invention is to provide a compression engine braking system including a control valve having a slidably mounted control valve member wherein the linear motion of the control valve member is minimized while still maintaining the fluid supply pressure below a predetermined level.

These and other objects are achieved by providing a compression braking system for an internal combustion engine having at least one piston reciprocably mounted within a cylinder for cyclical successive compression and expansion strokes, an exhaust valve operable to open against a closing bias force to exhaust gas from the cylinder in variable timed relationship to the piston strokes to operate the engine in either a power mode or a braking mode and having an engine component, such as a fuel injector train, mechanically actuated near the end of each compression stroke of the piston when the engine is operated in the power mode. The braking system includes a fluid pressurizing or master piston mechanically linked with the engine component and an actuating or slave piston fluidically connected to the master piston by a high pressure circuit and mechanically connected to the exhaust valve for opening the exhaust valve whenever the level of pressurization of the fluid in the high pressure circuit is sufficient to overcome all forces biasing the exhaust valve to a closed position. The master piston is used to pressurize the fluid in the high pressure circuit in response to the mechanical actuation of the engine component when the engine is operated in the braking mode thereby creating a hydraulic link between the master piston and the slave piston. A low pressure circuit delivers low pressure fluid to the high pressure circuit via a control valve which controls the flow of fluid between the high and low pressure circuits. A pressure relief valve fluidically connected to the low pressure supply circuit is operable to be placed in an open position to vent fluid from the low pressure circuit while the engine is continuously operated in the braking mode. The system may include a fluid source for supplying low pressure fluid to the low pressure circuit and a supply valve positioned along the low pressure circuit for controlling the flow of fluid from the fluid source into the low pressure circuit. The control valve may include a check valve positioned along the low pressure circuit between the pressure relief valve and the high pressure circuit for preventing the flow of fluid from the high pressure circuit to the low pressure circuit. The relief valve may be connected to the low pressure circuit between the supply valve and the control valve and may include a spring bias check valve normally biased in a closed position and movable into the open position whenever the pressure in the low pressure circuit reaches a predetermined level. The pressure relief valve is operable to maintain the fluid in the low pressure circuit below a predetermined pressure level equivalent to a maximum high pressure level in the high pressure circuit to prevent inadvertent, untimely movement of the exhaust valves into the cylinder of the engine. The supply valve may be a solenoid operated three-way valve movable between a first position corresponding to the braking mode of the engine in which low pressure fluid is supplied to the low pressure circuit and a second position corresponding to the power mode of the engine in which fluid flow from the fuel source to the low pressure circuit is blocked and the low pressure circuit is connected to a drain.

DETAILED DESCRIPTION OF THE PREFERRED EMBODIMENT

Figure 1:
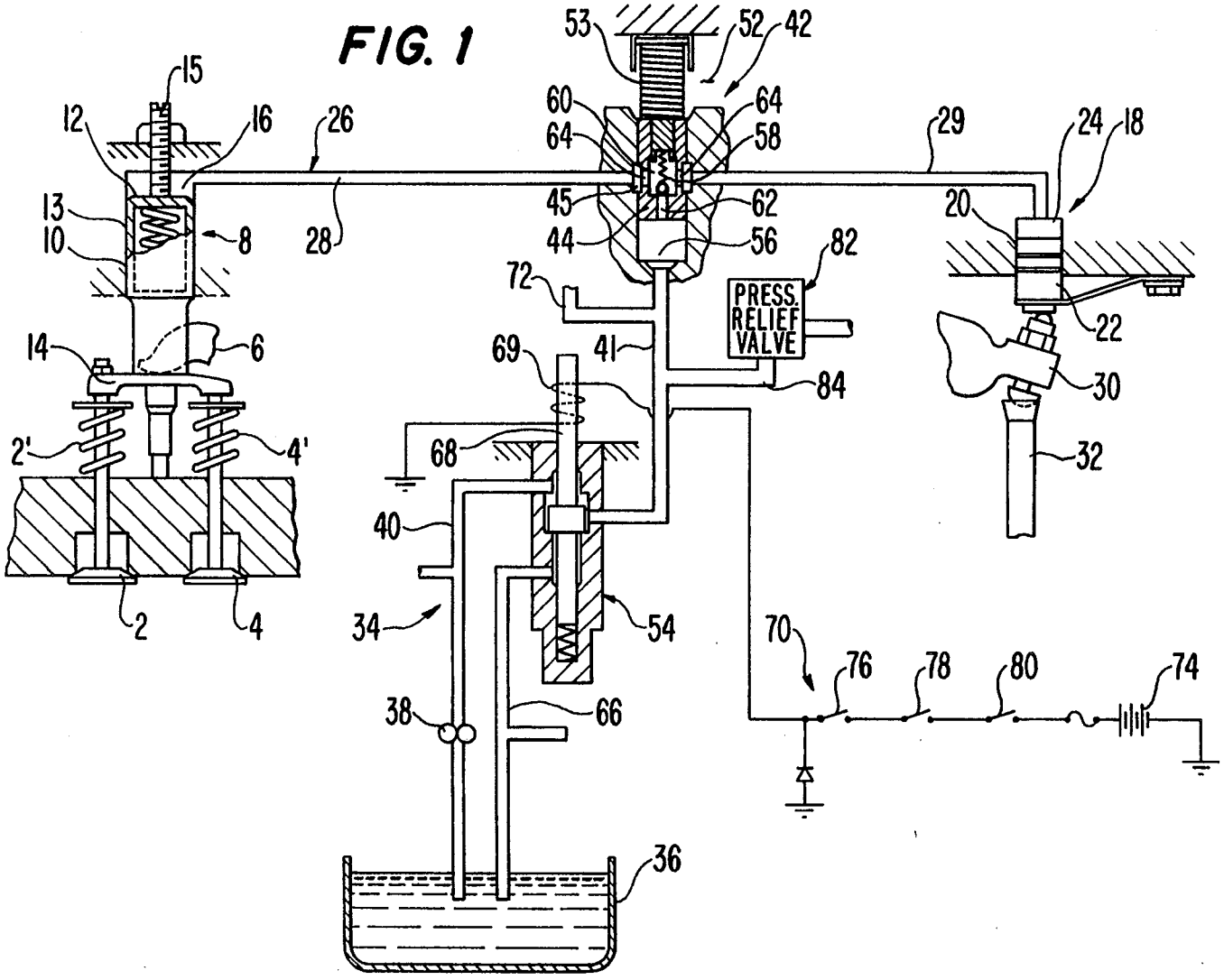
FIG. 1 is a diagrammatic illustration of an electrically and fluidically controlled braking system for a fuel injected internal combustion engine in accordance with the present invention.

Referring to FIG. 1, there is shown a hydraulically controlled compression braking system of the subject invention as employed in an internal combustion engine equipped with a cam operated fuel injector train, whereby the engine may be converted from a power mode of operation to a braking mode, and maintained in the braking mode, without giving rise to excessively high fluid pressure in the high pressure hydraulic circuit due to excessively high supply fluid pressure, while allowing continuous, uninterrupted operation of the engine in the braking mode. In particular, the system of FIG. 1 discloses a Jacobs-type compression brake system such as disclosed in U.S. Pat. No. 3,405,699 including a pair of exhaust valves 2 and 4 associated with a single engine piston for simultaneous operation by an exhaust rocker lever 6 during the normal power mode of engine operation. In such a power mode, the exhaust rocker lever 6 is connected in a valve train to a rotating cam which is designed to normally leave the exhaust valves closed during the compression and expansion strokes of the associated piston. However, as explained in U.S. Pat. No. 3,405,699 and also in U.S. Pat. No. 3,220,392, it is necessary to open at least partially the exhaust valves near the end of the compression stroke of the associated piston if it is desired to operate the engine as a compressor for braking purposes. As illustrated in FIG. 1, this result may be accomplished by providing an actuating means 8 in the form of a cylinder 10 and hydraulically actuated slave piston 12 mechanically connected to the exhaust valves 2 and 4 by a bridging element 14, for opening at least partially valves 2 and 4 whenever the cylinder cavity 16 above slave piston 12 is pressurized by fluid. At all other times, slave piston 12 is biased by a spring 13 toward a retracted position as illustrated in FIG. 1. An adjusting screw 15 is provided to permit adjustment of the fully retracted position of the slave piston 12.

In order to provide the necessary fluid pressure to cavity 16, the actuating means 8 is fluidically connected with a fluid pressurizing means 18 which is, in turn, mechanically connected with an engine element operated to be displaced periodically in timed relationship with the movement of the engine piston associated with exhaust valves 2 and 4 so as to cause the exhaust valves to open near the end of the compression stroke of the associated engine piston. The fluid pressurizing means 18 includes a cylinder 20 and a master piston 22 slidingly mounted within cylinder 20 to form a cavity 24 above the piston 22 communicating with cavity 16 through branch conduits 28 and 29 of a high pressure fluid circuit 26, and a control valve 42.

While piston 22 may be displaced by any element within the engine which is mechanically displaced during periodic intervals properly timed with respect to the desired times of opening of exhaust valves 2 and 4, piston 22 is illustrated as being displaceable by means of a fuel injector valve rocker arm 30 which normally exists in engines equipped with cam actuated fuel injection systems. The fuel injector rocker arm 30 is designed to rotate about a pivot (not illustrated) upon displacement by an injector push rod 32 which, in turn, is engaged by an associated injector rod cam lobe (not illustrated). Use of the fuel injector actuating mechanism to displace the master piston is particularly propitious in an engine equipped with a cam actuated fuel injection system because the fuel injector valve associated with each engine cylinder is timed to be displaced near the end of the compression stroke of the piston within the associated engine cylinder. Thus, the high pressure fluid circuit 26 connecting the fluid pressurizing means 18 and the actuating means 8 may be quite short.

A separate set of branch conduits 28 and 29 are provided for each set of fluidically connected actuating means 8 and fluid pressurizing means 18, whereby the opening of the exhaust valve (or valves) associated with each engine piston may be timed to occur (precisely) near the end of the compression stroke of the associated piston. In order to activate the braking system, however, it is necessary to charge each set of fluid conduits 28 and 29 with a supply of non-compressible fluid such as engine lubricating oil. In particular, the system may be provided with a sump such as a crank case 36 and a fluid pump such as a lubrication oil pump 38 for delivering low pressure fluid through conduits 40 and 41 of low pressure circuit 34 to high pressure circuit 26. A supply valve 54 is positioned along low pressure circuit 34 between conduit 40 and conduit 41 for controlling, in conjunction With control valve 42, the flow of low pressure fluid from low pressure circuit 34 to high pressure circuit 26 as explained more fully hereinbelow.

Figure 4B:
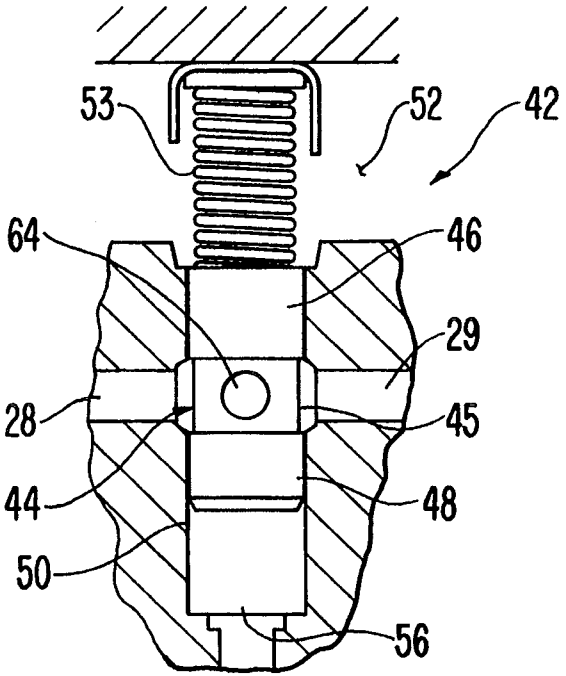
FIG. 4B is a partial cross-sectional view of the control valve of the present braking system shown in the charging position.
Figure 4A:
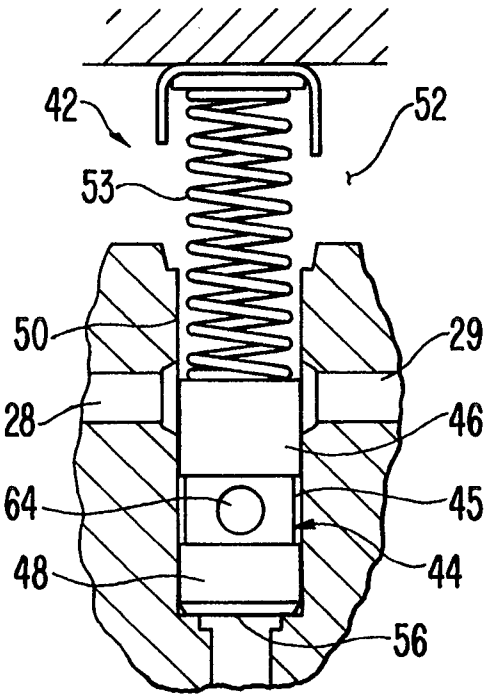
FIG. 4A is a partial cross-sectional view of the control valve of the subject braking system shown in the venting position.

As illustrated in FIGS. 1, 4A and 4B, control valve 42 includes a sliding member 44 movable between a charging position (FIGS. 1 and 4B) in which non-compressible fluid may flow into the high pressure fluid circuit 26 and a venting position (FIG. 4A) in which oil from lubrication pump 38 and low pressure circuit 34 is blocked from flowing into high pressure fluid circuit 26 and the non-compressible fluid within high pressure fluid circuit 26 is vented to the crank case 36. Specifically, sliding member 44 includes an annular groove 45 which forms an upper land 46 and a lower land 48 for sliding engagement with the walls of a cavity 50 within which sliding member 44 is positioned. When control valve 42 is in the venting position as shown in FIG. 4A, fluid is vented from high pressure circuit 26 around the upper edge of upper land 46 into the cavity above sliding member 44, which communicates with the engine overhead 52 for draining fluid to crank case 36. Since crank case 36 is at near atmospheric pressure, the pressure within high pressure circuit 26 is insufficient to cause slave piston 12 to open exhaust valves 2, 4 so long as sliding member 44 is in the venting position. A spring 53 is provided to bias the sliding member 44 toward the venting position. However, the bias of spring 53 is insufficient to hold the control valve 42 in the venting position when fluid from the pump 38 is passed into the cavity 56 below the sliding member 44. As shown in FIG. 1, a check valve 58 is provided within a cavity 60 which communicates with cavity 56 of low pressure circuit 34 via an axial passage 62. Cavity 60 also fluidically communicates with branch conduits 28 and 29 of high pressure circuit 26 via radial passages 64 and an annular groove 45 formed in sliding member 44. Annular groove 45 is positioned to register with branch conduits 28 and 29 when member 44 is in the charging position to permit fluid to flow into high pressure fluid circuit 26. The lubrication oil supplied by pump 38 is at a sufficiently low pressure in comparison with the bias of spring 13 on slave piston 12 and the closing bias on exhaust valves 2 and 4 produced in part by closing springs 2' and 4' so that exhaust valves 2 and 4 cannot be opened by the pressure produced by pump 38 alone. Check valve 58 is designed to permit operation of the system by preventing oil from venting from high pressure fluid circuit 26 so long as the sliding member 44 remains in the charging position thereby allowing pressure to build up in high pressure circuit 26 whenever master piston 22 is displaced upwardly resulting in the downward displacement of slave piston 12 in time sequence with the movement of injector push rod 32 and rocker arm 30.

Supply valve 54 directs oil supplied by pump 38 to conduit 41 which supplies oil to cavity 56 or cuts off the flow of oil from pump 38 and vents oil out of conduit 41 and back to the crank case 36 through a return line 66. Supply valve 54, therefore, may be of the solenoid-operated three-way type having a movable valve element 68 spring biased toward one position in which the oil is returned from conduit 41 to the crank case 36 and movable to another position, against the spring bias, by a solenoid 69 whenever the solenoid is energized, by means of an electrical control circuit 70 illustrated in FIG. 1 and described below. A separate control valve may be provided for each interconnected slave piston/-master piston set corresponding to the number of cylinders in the engine. If it is desired to operate all such slave piston/master piston sets simultaneously, a supply passage 72 is used to supply oil from three-way valve 54 to all other valves. Thus, all pistons are operated in a braking mode substantially simultaneously should it be desired to selectively convert individual engine pistons to a braking mode, a separate three-way supply valve must be provided for each control valve. Alternatively, certain cylinders may be grouped together so that, for instance, the vehicle operator may selectively convert two, four, six or eight cylinders to a braking mode of operation, in which case a separate three-way supply valve and supply passage is provided for each group of control valves it is desired to operate in unison.

Turning now to electrical control circuit 70, it can be seen that the circuit includes a plurality of switches connected in series between a battery 74 and the solenoid 69 such that all of the switches must be closed in order for solenoid 69 to be energized and the braking system set into operation. In particular, a fuel pump switch 76 is included to insure that the braking mode of operation is only possible when the engine fuel pump has been turned off. Thus, switch 76 closes when the fuel pump is turned to idle position off. A control switch 78 is also provided so that the engine may only be operated when the clutch is engaged, thereby insuring that the braking effect of the engine is transferred to the vehicle wheels. Finally, a dash switch 80 is provided to permit the operator to determine when he wishes to obtain braking effect from the vehicle's engine. Other control switches may, of course, be added.

Figure 2:
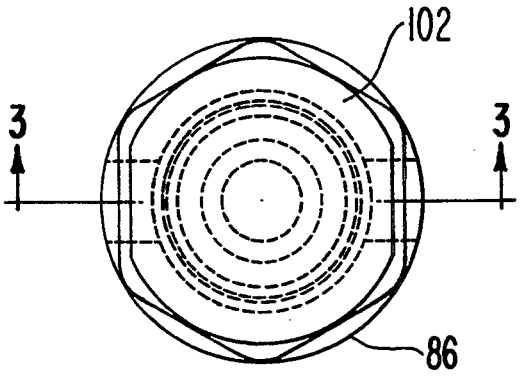
FIG. 2 is a top view of the fluid pressure relief valve for venting fluid from the low pressure fluid circuit of the braking system.
Figure 3:
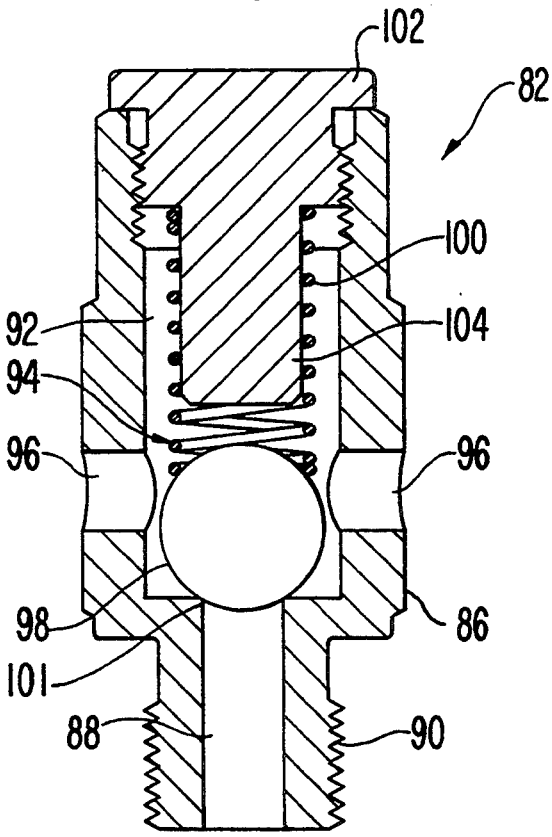
FIG. 3 is a cross-sectional view of the fluid pressure relief valve of the present invention taken along plane 3—3 of FIG. 2.

As described above, when it is desired to place the engine in the braking mode, solenoid valve 54 is moved to a position allowing low pressure fluid to be delivered through conduit 41 of low pressure circuit 34 and into cavity 56 adjacent sliding member 44. The low pressure of the fluid in cavity 56 displaces sliding member 44 upwardly as shown in FIG. 4B into the charging position aligning annular groove 45 with conduits 28 and 29 thereby allowing low pressure fluid to flow into high pressure circuit 26. The low pressure fluid entering high pressure circuit 26 is of a sufficient pressure to cause master piston 22 and slave piston 12 to displace downwardly until contacting the injector valve rocker arm 30 and the bridging element 14 of the valve assembly, respectively, thus forming a hydraulic fluid link in the high pressure circuit 26. However, it has been found that under certain operating conditions, supply fluid having an undesirably high fluid pressure may be supplied by the pump 38 through the low pressure supply circuit 34 into the high pressure circuit 26 during the braking mode causing inadvertent and excessive movement of the slave piston and exhaust valves inwardly beyond the design clearance limits established in the engine cylinder. As a result, the engine piston may collide with the exhaust valves damaging the valves, valve train assembly, piston/cylinder assembly and possibly other engine components. The present invention solves this problem by avoiding the delivery of excessively high supply fluid pressure to the high pressure circuit 26. As shown in FIGS. 1, 2 and 3, the braking system of the present invention includes a fluid pressure relief valve 82 fluidically connected to conduit 41 of low pressure circuit 34 between control valve 42 and supply valve 54 via a connecting passage 84. The pressure relief valve 82 functions to relieve fluid from the low pressure circuit 34 before the pressure in low pressure circuit 34 reaches a predetermined high level thereby preventing excessive oil pressure from reaching the high pressure circuit 26 and, consequently, the slave piston 12.

Specifically, as shown in FIGS. 2 and 3, the pressure relief valve 82 designed in accordance with the present invention includes a housing 86 containing an inlet port 88 connected to the connecting passage 84 by, for example, threads 90 formed on one end of the housing 86 for engaging complementary threads (not shown) formed in the connecting passage line. Alternatively, the pressure relief valve 82 may be directly threaded into conduit 41 of low pressure circuit 34. Inlet port 88 opens into an internal cavity 92 formed in housing 86 for housing a check valve assembly 94. Outlet ports 96 extend transversely from internal cavity 92 for connection to a drain line (not shown) which drains fluid from cavity 92 to a low pressure drain, such as crank case 36. The check valve assembly 94 includes a floating ball 98 biased by a spring 100 toward the inlet port 88 into sealing engagement with a valve seat 101 to prevent the flow of oil into the internal cavity 92 except when the pressure within low pressure circuit 26 reaches a predetermined high pressure level. When such predetermined pressure level is reached, floating ball 98 is moved upwardly as illustrated in FIG. 3 to cause fluid to be vented from low pressure circuit 26 and returned to the engine crank case. Internal cavity 92 is closed at one end opposite inlet port 88 by a plug 102 threadably attached to housing 86. Plug 102 includes a spring guide/check ball stop portion 104 extending inwardly into internal cavity 92 for both guiding spring 100 while also functioning as an end stop for limiting the upward movement of floating ball 98.

To operate the braking system, the electrical control circuit must be conditioned to supply current to the three-way solenoid supply valve 54 by closing fuel pump switch 76, the clutch switch 78 and the dash switch 80. When so set, the electrical control circuit energizes solenoid 69 forcing the movable valve element 68 downwardly to cause fluid flow from pump 38 through three-way supply valve 54 into conduit 41 forcing sliding member 44 of control valve 42 upwardly to its charging position. Fluid flowing from low pressure circuit 34 into cavity 56 has the additional effect of opening check valve 58 to charge high pressure fluid circuit 26. However, at this point, the pressure in the high pressure circuit 26 is still not high enough to force the slave piston 12 downwardly to open the valves 2 and 4 and allow the associated engine cylinder (not illustrated) to act as a compressor. At the appropriate time, in the engine cycle, the injector push rod 32 is forced upwardly against the master piston 22 thereby increasing the pressure in the high pressure fluid circuit 26 sufficiently to force the slave piston 12 downwardly in order to open valves 2 and 4. Upon return of the injector push rod, slave piston 12 is caused to retract and close the exhaust valve so that a new charge of air may be drawn into the cylinder, compressed and released upon the next advance of the injector push rod 32. If at any time during the operation of the braking system in the braking mode excessively high pressure levels are experienced in low pressure circuit 34, such as may result from use of highly viscous lube oil or malfunctioning of the lube oil supply pump, pressure relief valve 82 will open at a predetermined pressure level to release fluid from low pressure circuit 34 causing fluid pressure in circuit 34 to remain below the equivalent pressure that would cause the slave piston 12 to overdisplace downwardly toward the exhaust valves. In this manner, pressure relief valve 82 prevents high pressure surges in low pressure circuit 34 from reaching high pressure circuit 26 which may result in excessive movement of slave piston 12 and damage to various components of the engine. Pressure relief valve 82 is connected to low pressure circuit 34 between supply valve 54 and control valve 42 relatively close to control valve 42 so that pressure losses in conduits 40 and 41 are more easily considered in determining the pressure level required to open pressure relief valve 82. Consequently, the lifting pressure of pressure relief valve 82 can be more accurately set to the expected pressure value equivalent to the pressure that would cause the slave piston to overdisplace.

Figure 5C:
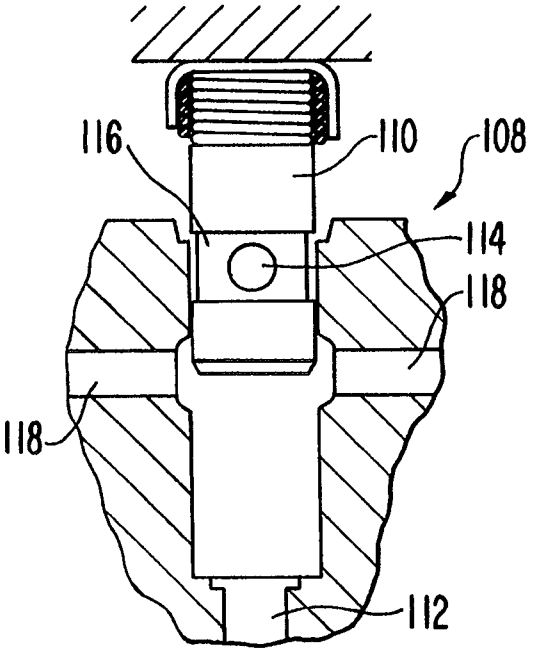
FIG. 5C (PRIOR ART)
FIGS. 5A, 5B and 5C are partial cross-sectional views of a prior art control valve having two biasing springs shown in the venting position, charging position and pressure relief positions, respectively.
Figure 5B:
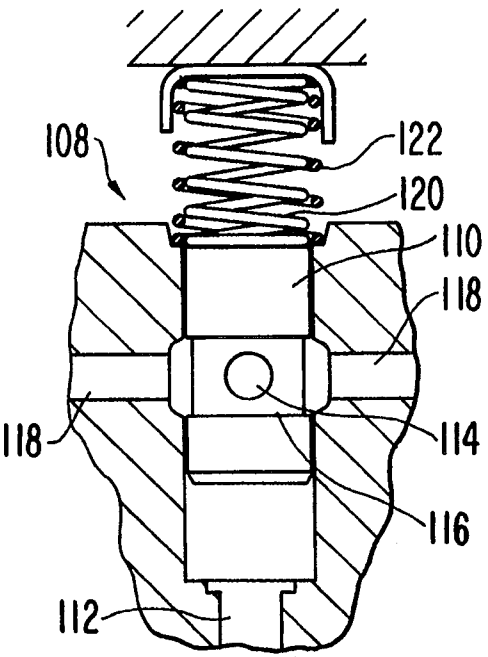
FIG. 5B (PRIOR ART)
Figure 5A:
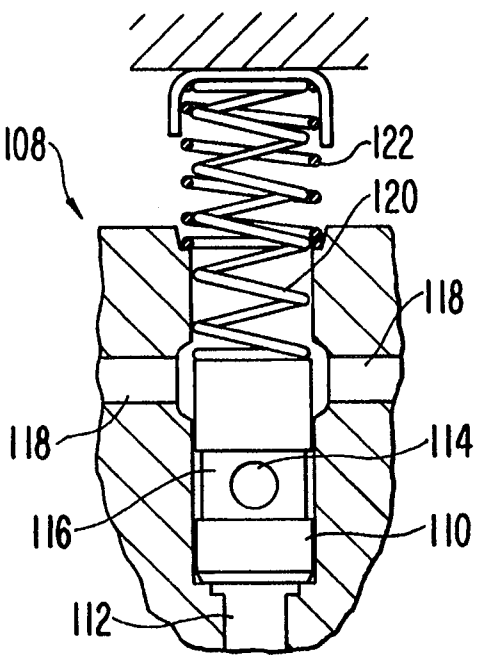
FIG. 5A (PRIOR ART)

One important advantage of the present invention is that inadvertent and excessive movement of the slave piston 12, due to excessively high supply pressure in low pressure circuit 34, can be successively prevented while allowing continuous, uninterrupted operation of the engine in the braking mode. For example, FIGS. 5A–5C illustrate a prior art relief device incorporated into the control valve of the braking system. Similar to the present invention, the sliding member 110 is spring biased into a venting position as shown in FIG. 5A and movable by low pressure supply fluid into a charging position as shown in FIG. 5B. In addition, the sliding member 110 functions as a relief valve by moving an additional linear distance outwardly to the position shown in FIG. 5C in response to excessively high fluid pressure flowing from low pressure circuit 112 to allow this fluid to flow through the check valve (not shown) in sliding member 110 and out through radial passage 114 and annular groove 116 into the engine overhead drain. However, while the control valve 108 is functioning as a relief valve dumping supply fluid to drain, the high pressure circuit 118 is also connected to the overhead drain via the control valve 108. As a result, while the control valve 108 is functioning as a relief valve for the low pressure circuit 112, it is also functioning as a relief valve for high pressure circuit 118, thus, disabling the hydraulic fluid link fluidically connecting the master piston and the slave piston thereby rendering the operation of the brake system inoperative. Each time control valve 108 functions as a relief valve, the braking mode of operation is interrupted. As a result, the braking system is not as reliable and effective as is desirable. However, the present invention creates a more reliable and effective braking system by maintaining the fluid supply pressure below a maximum predetermined level while permitting the continuous, uninterrupted operation of the engine in a braking mode. This is accomplished by pressure .relief valve 82 of the present invention which accurately and reliably maintains the fluid supply pressure in the low pressure circuit 34 below a maximum predetermined level equivalent to the pressure that would cause the slave piston to overdisplace, without disabling the hydraulic link in the high pressure circuit 26.

Another important advantage of the present invention is also illustrated by FIGS. 4A and 4B in comparison to prior art control valves shown in FIGS. 5A–5C. The control valves of the prior art as shown in FIGS. 5A–5C require an inner spring 120 for biasing the sliding member 110 into the venting position and a second outer spring 122 positioned around inner spring 120 for providing an-intermediate position as shown in FIG. 5B corresponding to the charging position. The outer spring 122 functions to allow the sliding member 110 to displace an additional axial distance outwardly into a relief position, as shown in FIG. 5C, compressing outer spring 122 when the predetermined pressure level is reached in the low pressure circuit 112 thereby providing the relieving function. However, as a result, the inner spring must also compress during movement of the sliding member into the relieving position. Through experience, it has been found that this additional linear motion of the inner spring causes excessive stress in the spring ultimately resulting in failure. In addition, design of a more appropriate and durable spring has been limited by the allowable package size of the control valve which does not permit for a spring design capable of withstanding the necessary displacements of this prior art valve design. The present invention avoids these problems by separating the relief valve from the control valve thereby eliminating the outer spring and minimizing the axial displacement of the sliding member and, thus, the inner spring thereby reducing the frequency of inner spring failure. As a result, the maintenance costs of the braking system are reduced while the reliability of the system is enhanced.

Industrial Applicability

The disclosed braking system for avoiding the adverse effects of high pressure surges in the low pressure supply circuit of a compression braking system finds particular utility in heavy duty engines such as compression ignition engines used on highway vehicles. The braking system, and especially the pressure relief valve, of the present invention is sufficiently simple to be easily retro-fitted in an existing engine without major modification.

We claim:

1. A braking system for an internal combustion engine having at least one piston reciprocably mounted within a cylinder for cyclical successive compression and expansion strokes and an exhaust valve operable to open against a closing bias to exhaust gas from the cylinder in variable timed relationship to the piston strokes to operate the engine in either a power mode or a braking mode and having an engine component mechanically actuated near the end of each compression stroke of the piston when the engine is operated in the power mode, said braking system comprising:

a fluid pressurizing means mechanically linked with the engine component for pressurizing a fluid in response to the mechanical actuation of the engine component whenever the engine is operated in the braking mode;

an actuating means fluidically connected to said pressurizing means and mechanically connected to the exhaust valve for opening the exhaust valve whenever the level of pressurization of the fluid is sufficient to overcome all forces biasing the exhaust valve to a closed position;

a high pressure circuit containing the fluid and fluidically connecting said fluid pressurizing means and said actuating means;

a low pressure circuit connected to said high pressure circuit for delivering low pressure fluid to said high pressure circuit;

a control valve means positioned along said low pressure circuit for controlling the flow of fluid between said low pressure circuit and said high pressure circuit; and a pressure relief valve means fluidically connected to said low pressure supply circuit, said pressure relief valve means operable to be placed in an open position to vent fluid from said low pressure circuit, wherein the engine may be continuously operated in the braking mode while said pressure relief valve means is in said open position.

2. The braking system of claim 1, further including a fluid source for supplying low pressure fluid to said low pressure circuit, and a supply valve positioned along said low pressure circuit for controlling the flow of fluid from said fluid source into said low pressure circuit, said pressure relief valve means being fluidically connected to said low pressure circuit between said supply valve and said control valve means.

3. The braking system of claim 2, wherein said control valve means includes a check valve positioned along said low pressure circuit between said pressure relief valve means and said high pressure circuit for preventing the flow of fluid from said high pressure circuit to said low pressure circuit.

4. The braking system of claim 1, wherein said pressure relief means includes a spring biased check valve normally biased in a closed position by a bias spring and movable into said open position whenever the pressure in said low pressure circuit reaches a predetermined level.

5. The braking system of claim 2, wherein said supply valve is a solenoid-operated three-way valve movable between a first position corresponding to the braking mode of the engine in which low pressure fluid is supplied from said fluid source into said low pressure circuit and a second position corresponding to the power mode of the engine in which fluid flow from said fluid source to said low pressure circuit is blocked and said low pressure circuit is connected to a drain.

6. The braking system of claim 1, wherein a hydraulic fluid link is formed in said high pressure circuit between said pressurizing means and said actuating means whenever said engine is operated in said braking mode, said hydraulic link being maintained while said pressure relief valve means is in said open position.

7. The braking system of claim 1, wherein said pressure relief valve means is operable to maintain the fluid in said low pressure circuit below a predetermined pressure level equivalent to a maximum high pressure level in said high pressure circuit to prevent the exhaust valve from moving an excessive distance into the cylinder of the engine.

8. A braking system for a fuel injected internal combustion engine having at least one piston reciprocably mounted within a cylinder for cyclical successive compression and expansion strokes and an exhaust valve operable to open against a closing bias to exhaust gas from the cylinder in variable timed relationship to the piston strokes to operate the engine in either a power mode or a braking mode and having a fuel injector train mechanically actuated near the end of each compression stroke of the piston to inject fuel into the cylinder when the engine is operated in the power mode, said braking system comprising:

a fluid pressurizing means mechanically linked with the fuel injector train for pressurizing a fluid in response to the mechanical actuation of the pushrod device whenever the engine is operated in the braking mode;

an actuating means fluidically connected to said pressurizing means and mechanically connected to the exhaust valve for opening the exhaust valve whenever the level of pressurization of the fluid is sufficient to overcome all forces biasing the exhaust valve to a closed position;

a high pressure circuit fluidically connecting said fluid pressurizing means and said actuating means;

a low pressure circuit connected to said high pressure circuit for delivering low pressure fluid to said high pressure circuit;

a fluid source for supplying low pressure fluid to said low pressure circuit;

a supply valve positioned along said low pressure circuit for controlling the flow of fluid from said fluid source into said low pressure circuit;

a control valve means positioned along said low pressure circuit between said supply valve and said high pressure circuit for controlling the flow of fluid between said low pressure circuit and said high pressure circuit; and a pressure relief valve means fluidically connected to said low pressure circuit between said supply valve and said control valve means, said pressure relief valve means movable between a blocking position in which fluid flow from said low pressure circuit through said pressure relief valve is blocked and an open position in which said low pressure circuit is connected to a low pressure drain.

9. The braking system of claim 8, wherein the engine may be continuously operated in the braking mode while said pressure relief valve means is in said open position.

10. The braking system of claim 9, wherein said control valve means includes a check valve positioned along said low pressure circuit between said pressure relief valve means and said high pressure circuit for preventing the flow of fluid from said high pressure circuit to said low pressure circuit.

11. The braking system of claim 9, wherein said pressure relief means is a spring biased check valve normally biased in a closed position by a bias spring and movable into said open position whenever the pressure in said low pressure circuit reaches a predetermined level.

12. The braking system of claim 8, wherein said supply valve is a solenoid-operated three-way valve movable between a first position corresponding to the braking mode of the engine in which low pressure fluid is supplied from said fuel source into said low pressure circuit and a second position corresponding to the power mode of the engine in which fluid flow from said fuel source to said low pressure circuit is blocked and said low pressure circuit is connected to a drain.

13. The braking system of claim 9, wherein a hydraulic fluid link is formed in said high pressure circuit between said pressurizing means and said actuating means whenever said engine is operated in said braking mode, said hydraulic link being maintained while said pressure relief valve means is in said open position.

14. The braking system of claim 8, wherein said pressure relief valve means is operable to maintain the fluid in said low pressure circuit below a predetermined pressure level equivalent to a maximum high pressure level in said high pressure circuit to prevent the exhaust valve from moving an excessive distance into the cylinder of the engine.

* * * * *